United States Patent [19]

Bang

[11] Patent Number: 4,953,866

[45] Date of Patent: Sep. 4, 1990

[54] GOLF PUTTER HAVING A MIRROR

[76] Inventor: Kook B. Bang, 115 Bryn Mawr Ave., Newtown Square, Pa. 19073

[21] Appl. No.: 382,274

[22] Filed: Jul. 20, 1989

[51] Int. Cl.[5] ..... A63B 69/36

[52] U.S. Cl. ..... 273/183 D; 273/183 E; 273/164

[58] Field of Search ..... 273/163 R, 163 A, 164, 273/183 D, 183 E, 186 A, 193 R, 194 A, 35 A

[56] References Cited

U.S. PATENT DOCUMENTS

| | | | |
|---|---|---|---|
| D. 245,439 | 8/1977 | Thiel | 273/163 R |
| 3,319,964 | 5/1967 | Steinberg | 273/192 |
| 4,153,255 | 5/1979 | Woodson | 273/192 |
| 4,453,717 | 6/1984 | Solheim et al. | 273/192 |
| 4,540,179 | 9/1985 | Slagle | 273/192 |
| 4,688,799 | 8/1987 | Johnson | 273/192 |
| 4,844,468 | 7/1989 | Lee | 273/163 R |

*Primary Examiner*—George J. Marlo

*Attorney, Agent, or Firm*—Birch, Stewart, Kolasch & Birch

[57] ABSTRACT

A golf putter comprising a putting shaft, a putting head having a front face and a rear face, an aperture extending through the putting head from the front face to the rear face thereof, a supporting plate containing a mirror mounted to the rear face of the putting head and extending at an angle from the rear face, the mirror being mounted to coincide with the aperture disposed in the putting head, whereby the golfer, from a putting position can view both the ball and the hole by looking at the surface of the mirror.

5 Claims, 1 Drawing Sheet

GOLF PUTTER HAVING A MIRROR

BACKGROUND OF THE INVENTION

1. Field of the Invention

The present invention relates to a golf putter having a mirror to facilitate the correct stroking of the golf ball and more particularly, to improve the proper alignment of the putter head and body of the putter. The putter includes a supporting plate attached to the rear surface of the putter, extending from the opposite face of the putter at an angle of 45°. The supporting plate contains a mirror which coincides with an aperture disposed in the front face of the putter so that by looking at the mirror and through the aperture a correct alignment can be established between the putter head and the hole.

2. Description of the Prior Art

A large variety of golf putters are well know in the art. Also, a variety of practice putting devices are well known in the art. However, such golf putters and practice putting devices suffer from many problems. For example, it is difficult for a golfer to properly align the putter head and his body for developing a smooth putting stroke.

SUMMARY OF THE INVENTION

Accordingly, it is an object of the present invention to provide a golf putter with a mirror to correct the ball stroking procedure.

Another object of the present invention is to provide an improved golf putter which includes a mirror attached to a plate which is mounted to the rear face of a putter at an angle of 45°, the mirror coinciding with an aperture extending through the front face of the putter body for properly aligning the golf with the hole.

A further object of the present invention is to provide a golf putter which further includes a transparent plastic cover for covering the aperture disposed on the club surface, the transparent plastic cover in the vicinity of the "sweet spot" on the putter face.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a golf club putter having a mirror attached to a supporting plate mounted to the rear portion of a putter body at an angle of 45°, and an aperture disposed in the face of the putter body which matches with the mirror for correcting the putting stroke.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
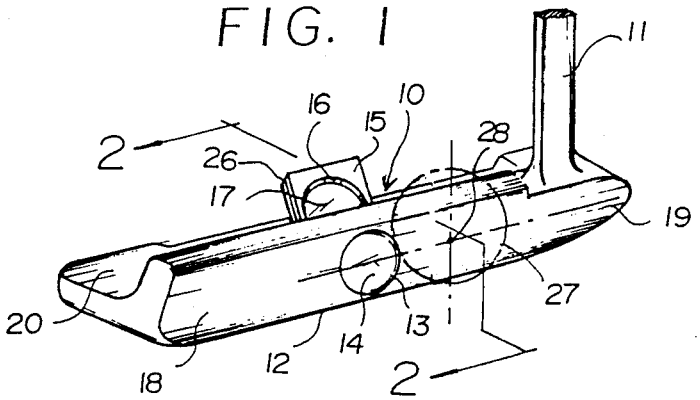
FIG. 1 is a perspective view of a putter having a mirror for correct stroking according to the present invention.
Figure 2:
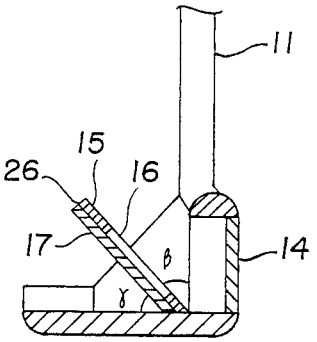
FIG. 2 is a cross-sectional view of FIG. 2.
Figure 3:
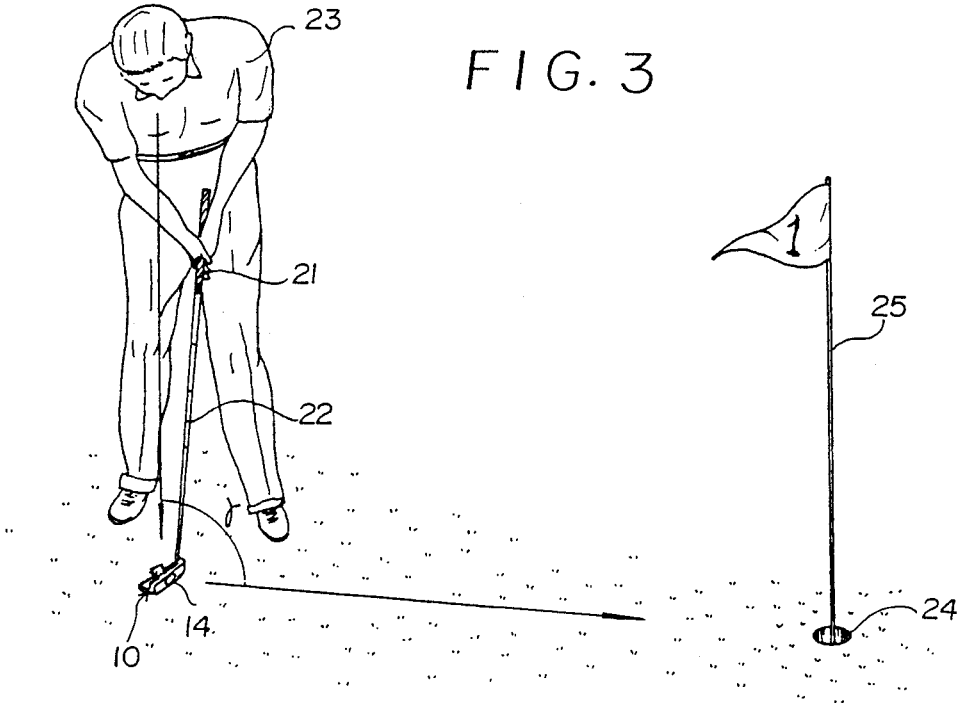
FIG. 3 is a pictorial view, showing a golfer using the golf putter having a mirror according to the present invention.

Referring now in detail to the drawings for the purpose of illustrating the preferred embodiments of the present invention, the golf putter 10 of the present invention contains a mirror 17 as an integral part thereof for helping to achieve the correct stroking of a golf ball as shown in FIGS. 1, 2, and 3 of the present application.

The putter further comprises a putter body 12 and a putter shaft 22. The putter body 12 includes a putter head 18, heel and toe portions 19 and 20, an aperture 13 disposed in the middle of a putter face surface in the vicinity of the "sweet spot" 28 of the putter 10, and a supporting plate 15 having a plate opening 16 for matching with the opening 13. The aperture 13 is covered with a glass or a rigid transparent plastic material 14 such as a thermoplastic. The supporting plate 15 supports the rear surface of a mirror 17 using a conventional adhesive material 26. Also, the supporting plate 15 is attached to the rear collector surface of the putter body 12 at an angle $\alpha$ of about 45°, so that angle $\beta$ is also established as being about 45°. Accordingly, the angle $\alpha$ plus the angle $\beta$ is an angle $\gamma$ of 90°. The putter shaft 22 includes a grip member 21 and a shaft heel 11.

In operation, as shown in FIG. 3, a golfer or the user 23 looks at the mirror 17 on the supporting plate 15 and adjusts the golf putter 10 so as to see a hole 24 or a flag stick 25. Thereafter, the golfer 23 swings at a golf ball 27 for impacting the ball at the "sweet spot" 28 of the putter. Thus, the golf putter 10 according to the present invention may be utilized to correct and improve the putting stroke of a golfer by helping him to correctly align his putter head and body for properly stroking the ball 27 toward the hole.

Although the mirror typically extends from the rear face of the putter at an angle $\alpha$ or $\beta$ of about 45°, it will be apparent that this angle will vary depending on preference of the golfer which is frequently determined by the size of the golfer. Thus this angle $\alpha$ or $\beta$ could be readily modified through custom design to fall within the range of 30°–60°. In this regard, it can be readily envisioned that the supporting plate which holds the mirror 17 could be mounted to be adjustable about a pivot point.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A golf putter comprising:

a putting shaft, a putting head having a front ball striking face and a rear face, viewing means extending through the putting head, below the upper edge of said front ball striking face, and extending from said ball striking front face to the rear face thereof, and a supporting plate containing a mirror mounted to the rear face of the putting head and extending at an angle of 45° from the rear face, said mirror being mounted in horizontal alignment with the viewing means disposed in the putting head, whereby the golfer, from a putting position can view both the ball and the flag marking the location of the hole by looking at the surface of the mirror to see through said viewing means.

2. The golf putter of claim 1, wherein said viewing means is an aperture covered with a rigid transparent plastic material.

3. The golf putter of claim 1, wherein said viewing means is an aperture covered with a transparent glass.

4. The golf putter of claim 1, wherein the mirror is adhesively attached to the supporting plate.

5. The golf putter of claim 1 wherein the viewing means is an aperture.

* * * * *